US009824642B2

(12) United States Patent
Andrysco et al.

(10) Patent No.: US 9,824,642 B2
(45) Date of Patent: Nov. 21, 2017

(54) RENDERING TECHNIQUES FOR TEXTURED DISPLAYS

(71) Applicant: Intel Corporation, Santa Clara, CA (US)

(72) Inventors: Nathan R. Andrysco, Chandler, AZ (US); Kevin L. Lin, Chandler, AZ (US)

(73) Assignee: INTEL CORPORATION, Santa Clara, CA (US)

( * ) Notice: Subject to any disclaimer, the term of this patent is extended or adjusted under 35 U.S.C. 154(b) by 669 days.

(21) Appl. No.: 14/040,101

(22) Filed: Sep. 27, 2013

(65) Prior Publication Data

US 2015/0091890 A1 Apr. 2, 2015

(51) Int. Cl.

*G09G 5/00* (2006.01)
*G09G 3/34* (2006.01)
*G09G 3/00* (2006.01)

(52) U.S. Cl.

CPC ..... *G09G 3/3473* (2013.01); *G09G 3/002* (2013.01); *G09G 2320/0233* (2013.01); *G09G 2320/0242* (2013.01); *G09G 2340/06* (2013.01)

(58) Field of Classification Search

CPC ..... G06T 15/04; G06T 15/005; G06T 19/00; G06T 11/001; G06T 1/60
USPC ..... 345/418, 419, 581, 582, 583, 584, 585, 345/586
See application file for complete search history.

(56) References Cited

U.S. PATENT DOCUMENTS 9,030,308 B1 * 5/2015 Buuck ..... G06F 3/0488 340/407.2
2007/0040777 A1 * 2/2007 Cummings ..... B81B 3/0051 345/84
2009/0015425 A1 * 1/2009 Palmqvist ..... H04M 1/0245 340/686.6
2009/0106655 A1 * 4/2009 Grant ..... G06F 1/3231 715/702
2010/0289740 A1 * 11/2010 Kim ..... G04G 21/04 345/157

(Continued)

OTHER PUBLICATIONS

Li,. J., Song, A., & Zhang, X. (Oct. 2010), "Haptic texture rendering using single texture image", In Computational Intelligence and Design (ISCID), 2010 International Symposium on (vol. 1, pp. 7-10), IEEE.*

(Continued)

*Primary Examiner* — Xiao Wu
*Assistant Examiner* — Sarah Lhymn
(74) *Attorney, Agent, or Firm* — Finch & Maloney PLLC

(57) ABSTRACT

Rendering techniques are disclosed for displays capable of adjusting/changing the angle of individual pixels (or pixel groups), referred to herein as textured displays. The textured displays may be capable of creating on demand textures which may be used to simulate the surface of an object in a scene. The rendering techniques may be used to improve upon the realism of rendered scenes/objects and they may provide users with a unique rendering experience whereby the textured display physically changes to mimic textures of the rendered scenes/objects. This can be achieved by sending geometric data, such as surface normal information, to individual pixels of the textured display. Other factors may be considered when adjusting the angle of individual pixels of the textured display, such as whether the user is experiencing too much glare.

25 Claims, 9 Drawing Sheets

(56) References Cited

U.S. PATENT DOCUMENTS

| | | | | |
|---|---|---|---|---|
| 2011/0149375 | A1* | 6/2011 | Kothari | G02B 26/001 359/291 |
| 2011/0316828 | A1* | 12/2011 | Shirbabadi | G06F 1/1603 345/207 |
| 2012/0050200 | A1* | 3/2012 | Vartanian | G06F 3/0416 345/173 |
| 2012/0099049 | A1* | 4/2012 | Yamazaki | G02F 1/133603 349/64 |

OTHER PUBLICATIONS

Ikedo, T., "Illumination Engine for a Billion Pixels per Second", /T. Ikedo//Technical Report HCIS-2203-03.-2003.-32 (Mar. 16, 2003) pp. 1-32.*

"Senseg Is Haptics Re-Imagined and Realized," Retreived from: http://senseg.com/technology/senseg-technology Dec. 30, 2013, 2 pages.

Velazco, "Tactus and Synaptics Create A Reference Tablet For OEMs With An Amazing, Disappearing Keyboard," Retrieved from: http://techcrunch.com/2013/05/06/tactus-and-synaptics-create-a-reference-tablet-for-oems-with-an-amazing-disappearing-keyboard/, May 6, 2013, 7 pages.

International Application No. PCT/US2013/055843, entitled, "A Display Apparatus Including MEMS Devices," Filed on Aug. 20, 2013, 28 pages.

* cited by examiner

RENDERING TECHNIQUES FOR TEXTURED DISPLAYS

BACKGROUND

Computer graphics is the art of projecting virtual three dimensional (3D) objects onto a two dimensional (2D) grid of pixels (the display). Rendering is the process of generating the 2D images from the 3D representations. In computer graphics rendering, shading refers to the process of altering the color of an object/surface/polygon in the 3D scene, based on its angle to virtual lights and distance from virtual lights, to create a photorealistic effect. In order to give objects an appearance of depth and realism, the graphics pipeline computes lighting and shading properties for the objects. This shading is generally computed using the object's surface normal, a user defined virtual viewpoint, and user defined virtual lights. Gouraud shading and Phong shading are two common interpolation techniques used for surface shading in 3D computer graphics.

DETAILED DESCRIPTION

Figure 1A:
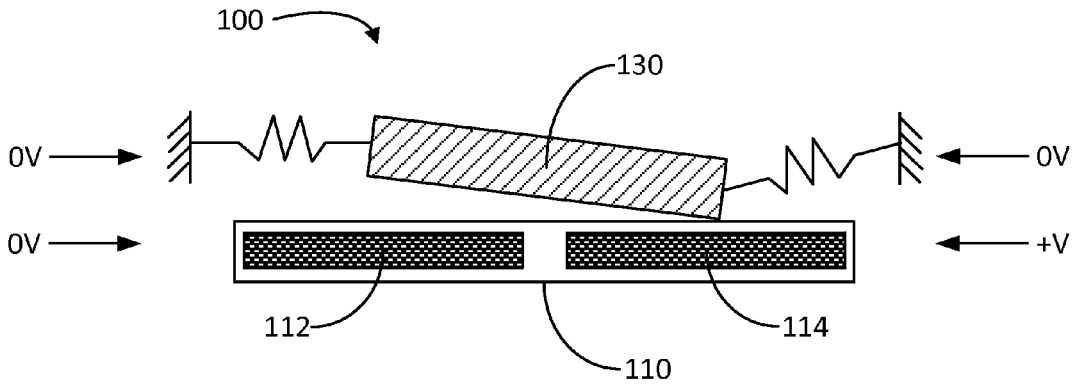
FIGS. 1*a-b* and 2*a-b* schematically illustrate example micro-electro-mechanical system (MEMS) devices with tiltable movable electrodes for an interferometric modulator display (IMOD) that can be used to provide rendering effects, in accordance with some embodiments of the present disclosure.

Rendering techniques are disclosed for displays capable of adjusting/changing the angle of individual pixels (or pixel groups), referred to herein as textured displays. The textured displays may be capable of creating on demand textures which may be used to simulate the surface of an object in a scene. The rendering techniques may be used to improve upon the realism of rendered scenes/objects and they may provide users with a unique rendering experience whereby the textured display physically changes to mimic textures of the rendered scenes/objects. This can be achieved by sending geometric data, such as surface normal information, to individual pixels of the textured display. So, for instance, the appearance of the rendered object on the textured display may be changed when lighting in the environment or the viewer's position is changed. Other factors may be considered when adjusting the angle of individual pixels of the textured display, such as whether the user is experiencing too much glare. Numerous variations will be apparent in light of this disclosure.

General Overview

As previously explained, computer graphics is the art of projecting virtual 3D objects onto a 2D grid of pixels (the display). As was also explained, shading in computer graphics rendering refers to the process of altering the color of an object/surface/polygon in the 3D scene, based on its angle to virtual lights and its distance from virtual lights, to create a photorealistic effect. For example, in the Phong shading model, surface normals are interpolated across rasterized polygons to compute pixel colors based on the interpolated normals and a reflection model. However, simulating shading of 3D objects using 2D displays has limitations, since 2D displays and their pixels are flat, and such displays only accept color information (e.g., red, green, and blue (RGB) values) needed to update pixels and output the final image.

Thus, and in accordance with one or more embodiments of the present disclosure, rendering techniques are disclosed for displays capable of adjusting/changing the angle of individual pixels (or pixel groups), referred to herein as "textured displays." In other words, when utilized with the rendering techniques provided herein, a given textured display is capable of creating on demand textures which may be used to simulate the surface of an object in a scene. Note that the term "pixel" as used herein may include any finite element of a display, such as volumetric pixels (voxels) or any other suitable finite element. As will be discussed in more detail below, a specific example of a textured display is an interferometric modulator display (IMOD), which includes micro-electro-mechanical system (MEMS) devices that are capable of tilting, as will be discussed in more detail below. Other examples of textured displays may include volumetric or holographic displays, or any display having the ability to adjust/change its physical properties to manipulate the angle of its individual pixels (or pixel groups). Note that the textured displays may use non-backlit or backlit display technologies, or some combination thereof, as will be apparent in light of this disclosure.

In some embodiments, the rendering techniques for textured displays described herein may be used to improve upon the realism of rendered scenes/objects. Software and/or hardware can use the capabilities of the textured displays to provide users with a unique rendering experience whereby the textured display physically changes to mimic textures of the rendered scenes/objects. This can be achieved, for example, by determining/calculating geometric data for the rendered scenes/objects and transferring the geometric data to the textured display to cause that display to adjust the angle of individual pixels (or groups of pixels) accordingly. Geometric data may include surface normal data or other suitable information as will be apparent in light of this disclosure. Once the individual pixels (or groups of pixels) of a textured display have been adjusted, the user's view of the displayed object changes as either light changes in the user's environment (e.g., changes position or intensity), or the user moves locations (and thus has a different viewing perspective). Other factors may be considered when adjusting the angle of individual pixels (or groups of pixels) within a textured display. For example, data may be collected to characterize or otherwise determine glare on the textured display, so that glare can be reduced or eliminated by self-adjusting the angle of pixels to reduce the effects of overly intense lighting on the user's eyes.

In accordance with some embodiments, use of the disclosed rendering techniques may be detected, for example, by performance inspection/evaluation of a given graphics rendering hardware/software. For example, where geometric data, such as pixel surface normal data, is output to a display, then the graphics rendering hardware/software may be utilizing one or more of the rendering techniques described herein. Use of the disclosed techniques may also be detected, in some embodiments, by inspection/evaluation of the rendering effects of a textured display. For example, if the display is changing its physical properties in some manner to adjust individual pixels (or pixel groups) to provide a more realistic image, then the textured display may be utilizing one or more of the rendering techniques described herein. Numerous variations and configurations will be apparent in light of this disclosure.

Textured Display Examples

FIGS. 1*a-b* and 2*a-b* schematically illustrate example micro-electro-mechanical system (MEMS) devices 100, 200 with tiltable movable electrodes for an interferometric modulator display (IMOD) configured to provide rendering effects, in accordance with some embodiments. Such configurations of a MEMS device may allow the device to selectively reproduce lights in one of two colors (e.g., through constructive interference), in addition to an opaque "off" state of the MEMS device 100, where no light is reproduced, for example.

Figure 1B:
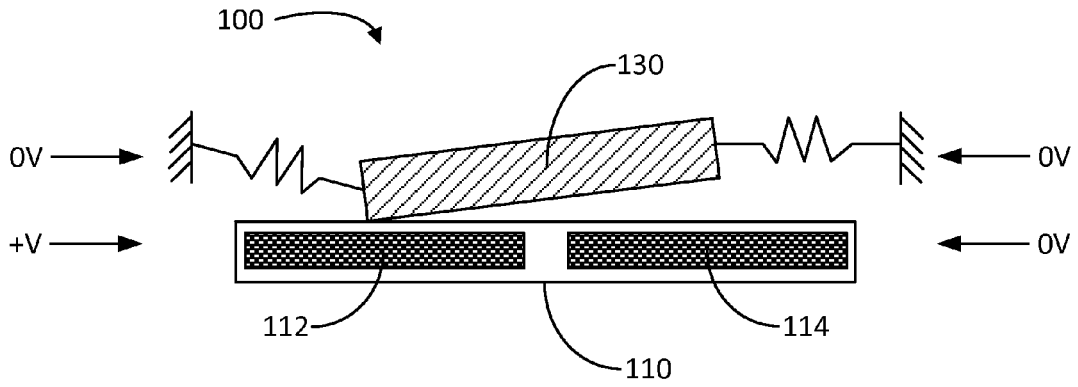

In some embodiments, the MEMS device 100 as illustrated in FIGS. 1*a-b* may include a bottom electrode 110 comprising two electrically separate portions (parts) 112 and 114, placed on opposite sides relative to a moveable electrode 130. In some embodiments, the moveable electrode 130 may be placed (e.g., suspended or affixed) using an arrangement 114, such as one or more springs, as shown. The two electrically separated parts 112 and 114 may be configured to cause the moveable electrode 130 to tilt toward a selected part (112 or 114) in response to selective application of an actuation voltage to the part. Actuation voltage may be supplied to the MEMS device 100 by an actuation circuit (not shown), for example. In other words, if actuation voltage is applied selectively to each part, the moveable electrode 130 may tilt accordingly. For example, if actuation voltage (indicated as +V) is applied to the part 114, the moveable electrode 130 may tilt toward the part 114 as shown in FIG. 1*a*. If actuation voltage is applied to the part 112, the moveable electrode 130 may tilt toward the part 112 as shown in FIG. 1*b*.

Figure 2A:
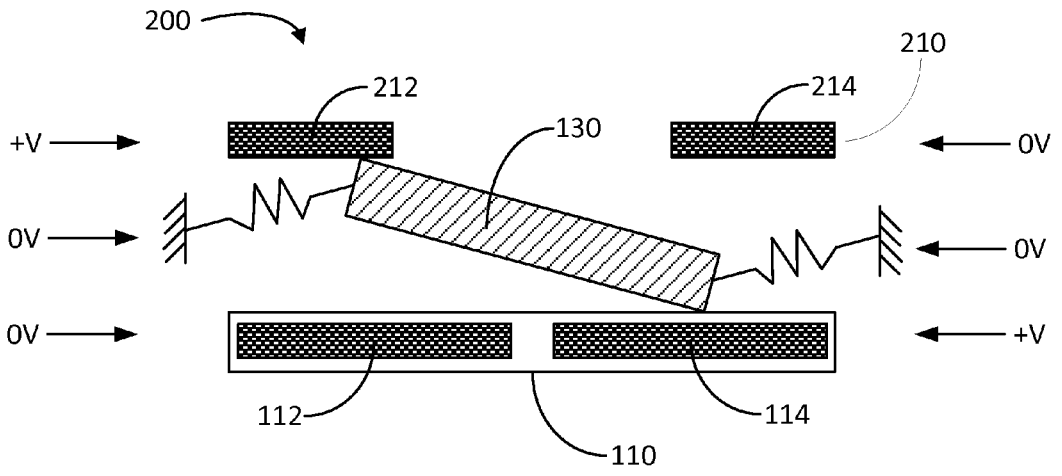
Figure 2B:
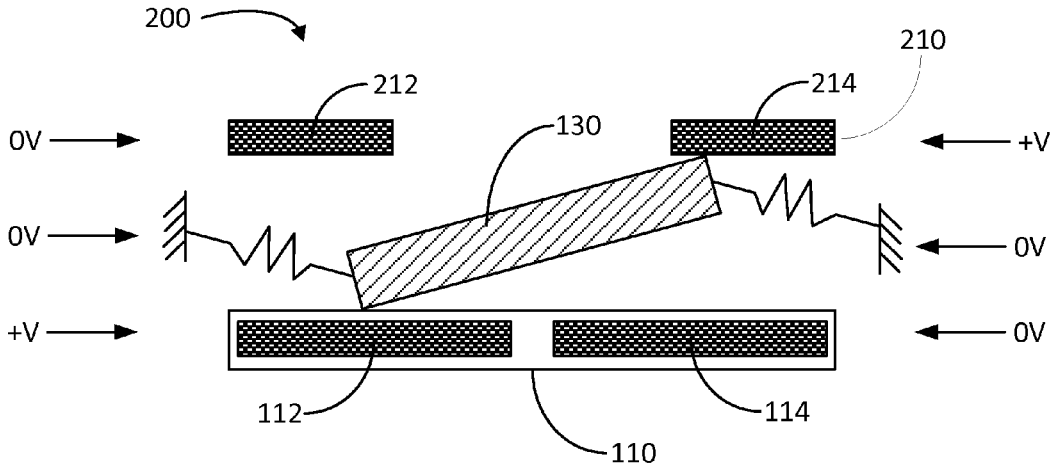

In some embodiments, the MEMS device 200 as illustrated in FIGS. 2*a-b* may include, in addition to, or in the alternative to the embodiments described in reference to FIGS. 1*a-b*, a top electrode 210. The top electrode 210 may include two separate parts 212 and 214, similar to the electrode 110 described above. Accordingly, when actuation voltage is applied to the part 212 and to the part 114, the moveable electrode may tilt toward the parts 212 and 114, as shown in FIG. 2*a*. When actuation voltage is applied to the part 214 and to the part 112, the moveable electrode may tilt toward the parts 214 and 112, as shown in FIG. 2*b*.

Tilting the moveable electrode 130 as described herein may enable a number of rendering effects. For example, if the moveable electrode 130 of the MEMS device described above is tiltable, e.g., to varying angles, the appearance of what is rendered to a display including the MEMS device may change based on the viewer's angle to the textured display or due to changes of lighting in the viewer's environment due to the specular and diffuse shading properties of the display, as will be discussed in more detail below. In some embodiments, a software application can pass geometric information of a rendered object onto a display including one or more MEMS devices 100 or 200, so as to tilt the moveable electrodes 130 according to the geometric parameters. The tilted moveable electrodes may thus mimic the object's surface as specified by the application.

The example textured display described above (IMOD including MEMS 100 or 200) is provided for illustrative purposes and is not intended to limit the present disclosure. Another example textured display, in accordance with some embodiments, may include Tactus™ Tactile Layer™ technology, which enables the display to rise up on demand. Other examples of textured displays, in accordance with some embodiments, may include volumetric or holographic displays, where 3D imagery is made visible to the unaided eye. Any other suitable textured display can be used to apply the rendering techniques described herein, such as a display that has the ability to adjust/change its physical properties, thereby having the ability to manipulate the angle of its individual pixels (or pixel groups).

Note that the textured displays may use non-backlit or backlit display technologies, or some combination thereof. For example, some textured displays may be entirely non-backlit, such as non-backlit electronic ink displays, which can use the rendering techniques described herein to angle the reflection of light in the viewing environment to cause a textured effect. Other textured displays may be backlit, which can use the rendering techniques described herein to angle the outgoing light from the display to cause a textured effect. Yet other textured displays may have some combination of non-backlit and backlit technologies, such as electronic ink displays with a built-in light, which can use the rendering techniques described herein to both reflect light in the user's viewing environment and angle the outgoing light (from the built-in light) to cause a textured effect. Numerous variations and configurations will be apparent in light of this disclosure.

Rendering Techniques and Lighting Effects

Figure 3:
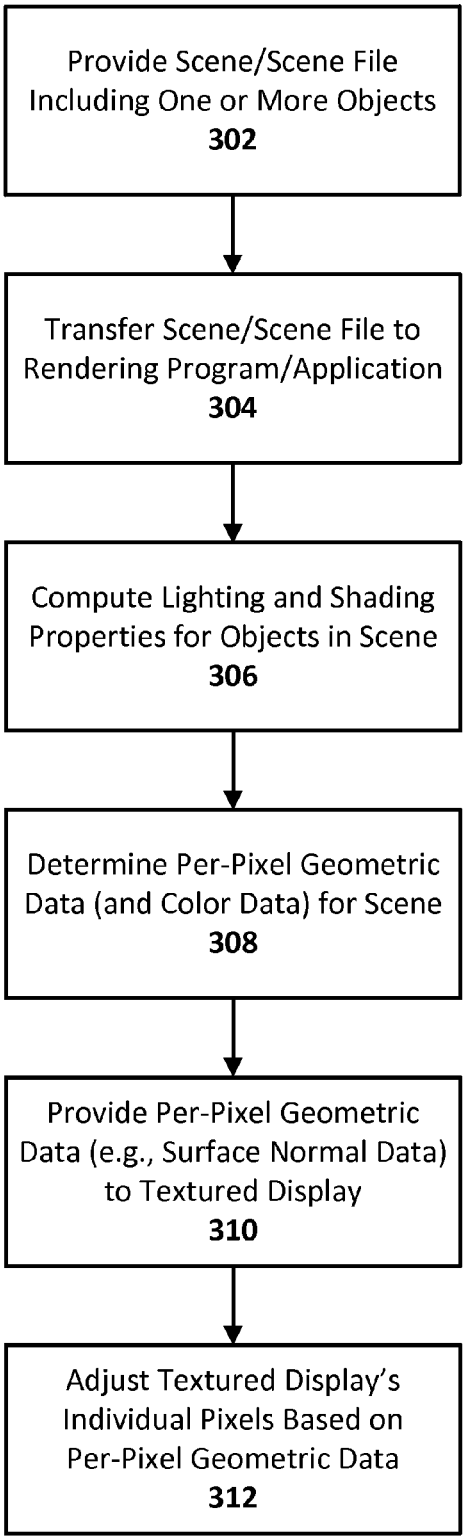
FIG. 3 illustrates an example graphics rendering method for a textured display using a graphics pipeline process, in accordance with some embodiments.

FIG. 3 illustrates an example graphics rendering method for a textured display using a graphics pipeline process, in accordance with some embodiments. As a general overview, the graphics or rendering pipeline may be mapped onto current graphics acceleration hardware such that the input to the GPU is in the form of vertices. These vertices can then undergo transformation and per-vertex lighting. A custom vertex shader program can then be used to manipulate the 3D vertices prior to rasterization. Once transformed and lit, the vertices may undergo clipping and rasterization resulting in fragments. A second custom shader program can then be run on each fragment before the final pixel values are output to the frame buffer for display. In some instances, a geometry shader program may be used to generate additional geometry (e.g., triangles) based on some user defined criteria. Such a geometry shader program may be run between the vertex shader program and the fragment shader program. There may be post-processing within the display or some intermediate process between the GPU and the display. For example, color correction or conversion may be performed (e.g., RGB to HSV color space).

The method starts with providing 302 a scene or scene file which may include one or more objects. The scene may be an image, a frame from a video, or any other suitable visual information as will be apparent in light of this disclosure. In some embodiments, the scene may be provided by memory/storage, a central processing unit (CPU), an accelerated processing unit (APU), or a graphics processing unit (GPU) of a computing device, for example. The scene may be created out of geometric primitives (e.g., using triangles), in some embodiments, which may be referred to herein as a 3D model or 3D mesh. In some embodiments, the 3D model of the scene may be comprised of point clouds, implicit surfaces (e.g., where a sphere is defined by its center and radius), or voxel representations (e.g., using octree data structures). Alternatively, the scene may be prepared for a raytracing or raycasting rendering process, which will be discussed in more detail below.

The method continues by transferring 304 the scene or scene file to a rendering program or application. In some embodiments, the rendering program may be located on the CPU or GPU of a computing device. The method continues by computing 306 the lighting and shading properties for the object(s) in the scene. This may include computing one or more of the following: shading, texture-mapping, bump-mapping, shadows, reflections, or other suitable properties. The techniques involved may include rasterization or scan conversion, raycasting, raytracing, or any other suitable technique as will be apparent in light of this disclosure. In addition, various transformations may occur before computing 306 the lighting and shading properties, such as modeling, coordinate, camera, or projection transformation. For example, the originally provided scene may be transformed from the local coordinate system to the 3D world coordinate system, and then transformed into a 3D camera coordinate system (e.g., with the camera as the origin). In some embodiments, clipping may be performed, for example, to minimize memory/storage.

The method continues by determining 308 per-pixel geometric and color data for the scene. The 3D model data (or 3D mesh data) previously computed may include colors, normal, textures, or other geometric information. Typically, individual fragments (or pre-pixels) are only assigned a color based on values interpolated from the vertices during rasterization, from a texture in memory, from one or more shader programs, or from some other suitable technique using the color and geometric data for the 3D model. However, the rendering techniques described herein retain at least a portion of the geometric data, such as the per-pixel surface normal data, to provide 310 the per-pixel geometric data to the textured display. In this manner, the textured display can utilize the geometric data to physically adjust 312 the angle of its pixels (or change its "texture") to reflect the rendered object's surface.

Adjustment 312 of the textured display's individual pixels based on the per-pixel geometric data may depend on the specific textured display being used. For example, if the textured display being used is an IMOD including one or more of the tiltable MEMS devices as shown in FIGS. 1*a*-2*b* and described herein, the appropriate actuation voltage may be applied to cause the MEMS device to tilt in the appropriate direction based on the geometric data. More specifically, the per-pixel surface normal data may be used to cause the appropriate actuation voltages to be applied. For example, if the per-pixel surface normal data is provided in vector format (e.g., [a, b, c], for a pixel in a plane given by the equation $ax+by+cz+d=0$), then the surface normal data may be converted to the appropriate actuation voltage. Such a conversion may be performed by a GPU, a CPU (e.g., during post-processing), an APU, or by a textured display, for example.

Figure 4A:
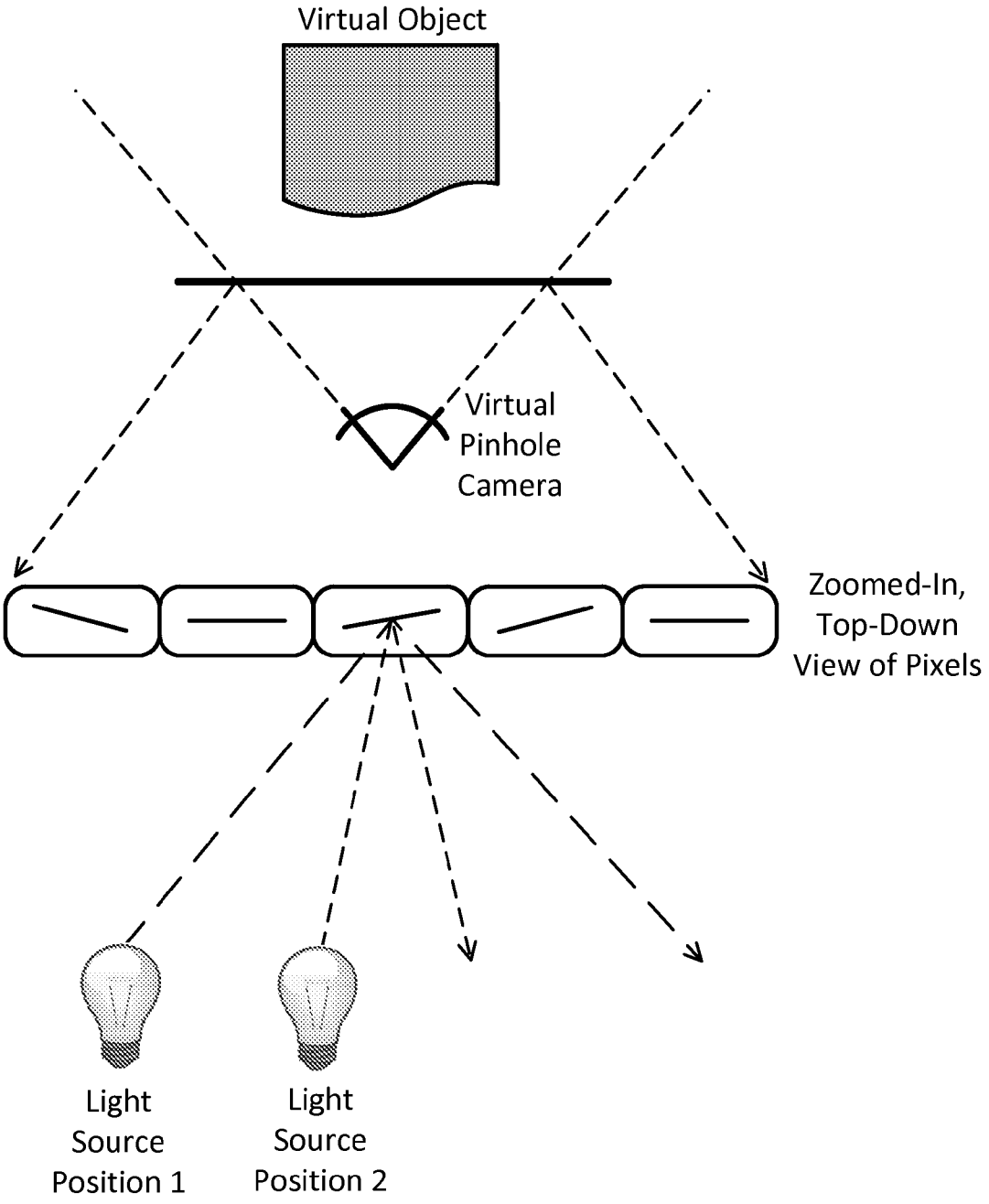
FIGS. 4*a-b* illustrate an overhead view of an example virtual object being displayed using a textured display, in accordance with some embodiments.
Figure 4B:
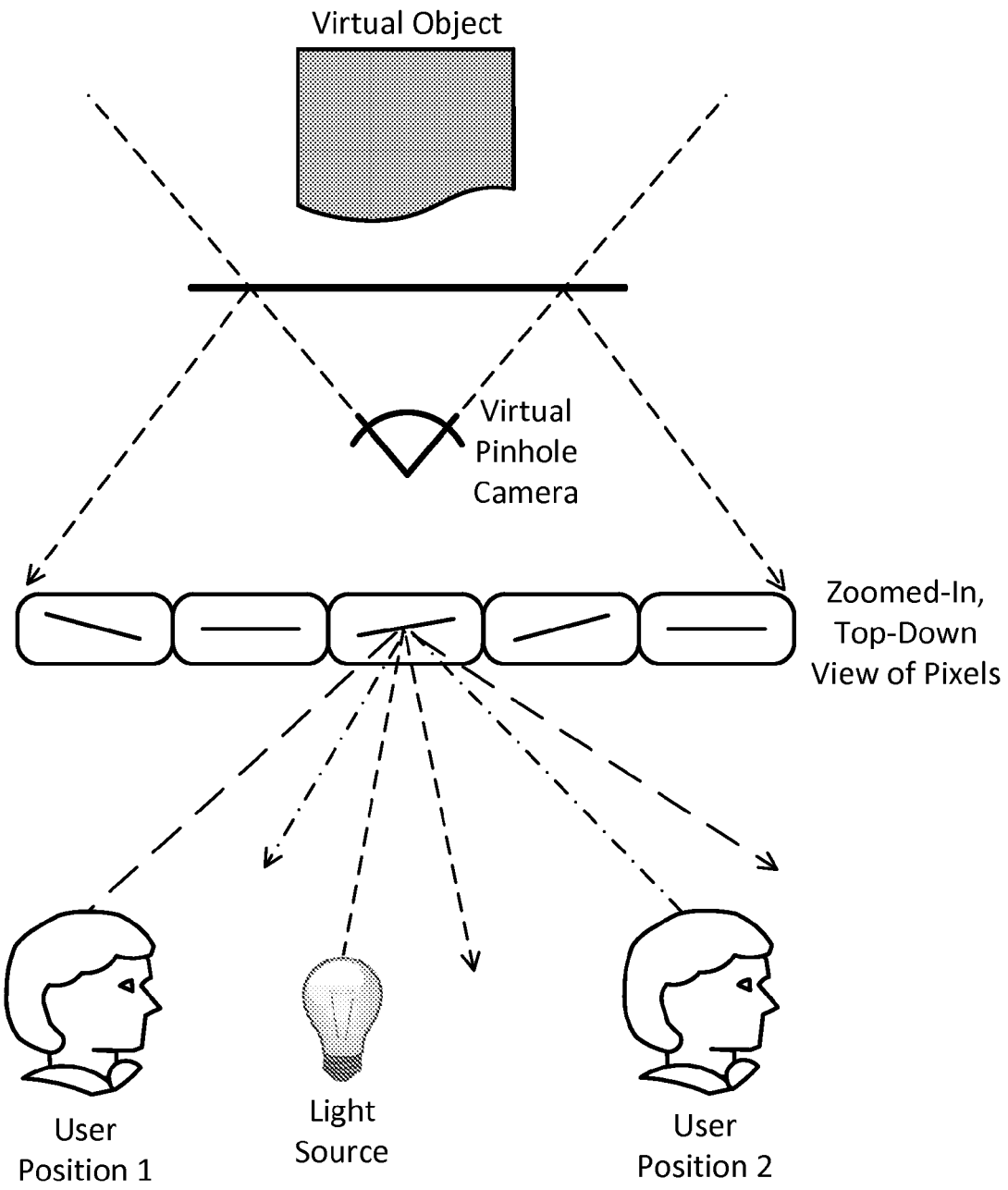

FIGS. 4*a*-*b* illustrate an overhead view of an example virtual object being displayed using a textured display, in accordance with some embodiments. The virtual object is shown behind the image plane being detected using a virtual pinhole camera. The texture of the virtual object, which is closest to the image plane, can be seen in this view. After the geometric data was determined for this virtual object, such as the per-pixel surface normal data, that information was transmitted to the textured display to cause the pixels to angle/tilt as shown. Note that the zoomed-in, top-down view of the row of five pixels are being used for illustrative purposes only. FIG. 4*a* illustrates how moving the light source in the real-life viewing environment (e.g., where the user exists) causes the appearance of the rendered object to change, since the angled pixels are reflecting the light differently based on the light source position (e.g., through diffuse shading). More specifically, the reflected light paths are shown for the middle pixel using light source position 1 and light source position 2.

FIG. 4*b* illustrates how moving a user's position (and therefore the user's viewing angle/perspective) causes the virtual object to appear to be rendered differently, since the reflected light is viewed differently from each viewing position (e.g., through specular shading). Note that the pixels shown in FIGS. 4*a*-*b* are tilted in one dimension (or along one axis); however, the present disclosure is not so limited. In some embodiments, the textured display may be capable of angling/tilting its pixels up to 5, 10, 15, 30, or 45 degrees, or some other suitable angle. Further, in some embodiments, the textured display may be capable of angling/tilting its pixels in two dimensions (or along two axes). The degree and dimension of tilt of individual pixels of a textured display may depend upon the specific display being used. In addition, such tilt degree/dimension limitations may be communicated from the textured display, or otherwise input, to a GPU, for example. In this manner, the textured display may not need any local intelligence and can render the buffers it receives without any additional processing.

Figure 5:
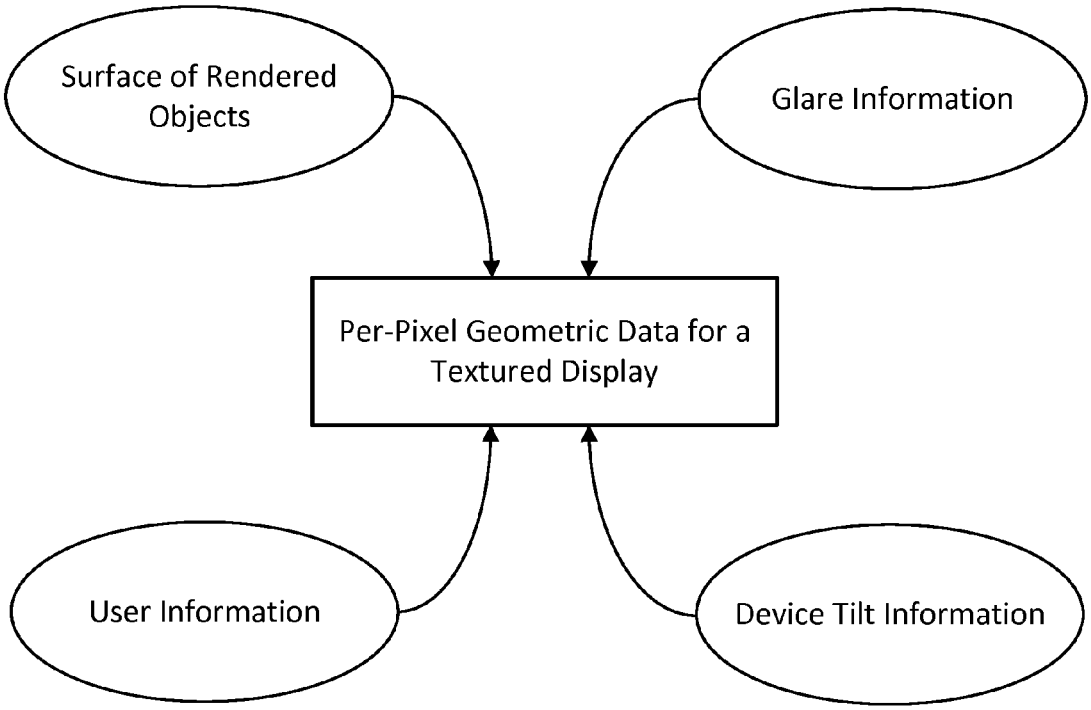
FIG. 5 illustrates multiple factors that may be considered when determining per-pixel geometric data for textured displays, in accordance with some embodiments.

In some embodiments, various factors may be considered in addition to, or instead of, the surface of rendered objects as previously described with reference to FIG. 3. FIG. 5 illustrates multiple factors that may be considered when determining per-pixel geometric data for textured displays, in accordance with some embodiments. As can be seen, various factors are being considered to determine per-pixel geometric data (e.g., surface normal data) for a textured display. After the geometric data is determined, that data can be transferred to the textured display to adjust the individual pixels accordingly. The first factor, surface of rendered objects, was previously described and may provide, for example, per-pixel surface normal data to a textured display. Note that although the techniques described herein are primarily discussed in the context of providing geometric data to individual pixels of a textured display, the present disclosure is not intended to be so limited. For example, geometric data may be provided to groups of pixels or other suitable finite elements of a display. Also note that physical adjustments made to textured displays (e.g., changing the angle of the pixels) may cause distortion (e.g., color distortion) of the displayed image and therefore, corrections may be made to compensate for such distortion.

The next factor, glare information, may be used to adjust the angle of pixels of a textured display to reduce the effects of overly intense lighting on the user's eyes. In an example embodiment, glare information may be collected using one or more light sensors to detect environmental light variation across the display. For example, if each pixel, or groups of pixels, had their own light sensors, and there was a strong enough variation among adjacent sensors, glare may be detected at those particular pixels (or groups of pixels). Another example of a glare detection method may include using cameras pointed at the textured display. Yet another example of a glare detection method may include user-defined glare detection, such as a user indicating on the textured display where the glare is located. Collected glare information may then be conveyed to the GPU (or other appropriate device) to correct for the glare (e.g., by adjusting the angle of the pixels).

The next factor, user information, may include detecting a user's viewing angle or collecting information on a user's viewing perspective. Such user information may be collected using a user-facing camera and the detected/collected information may be used when adjusting the textured display to compensate for the user's location relative to the display. The next factor, device tilt information, may include detecting/collecting the tilt angle of a device including a textured display. Such tilt information may be collected using accelerometers or gyroscopes and the detected/collected information may be used when adjusting the textured display to compensate for the device's tilt angle. These and other factors may be used to adjust a textured display for various practical purposes. For example, an electronic reader having a textured display may collect glare, tilt, and user information to enhance the user's reading experience by adjusting the textured display as described herein to increase the clarity (and reduce the glare) of the display. In another example, a rearview mirror for a car having a textured display as described herein may detect glare information and automatically adjust the textured display to reduce glare for the driver.

Example System

Figure 6A:
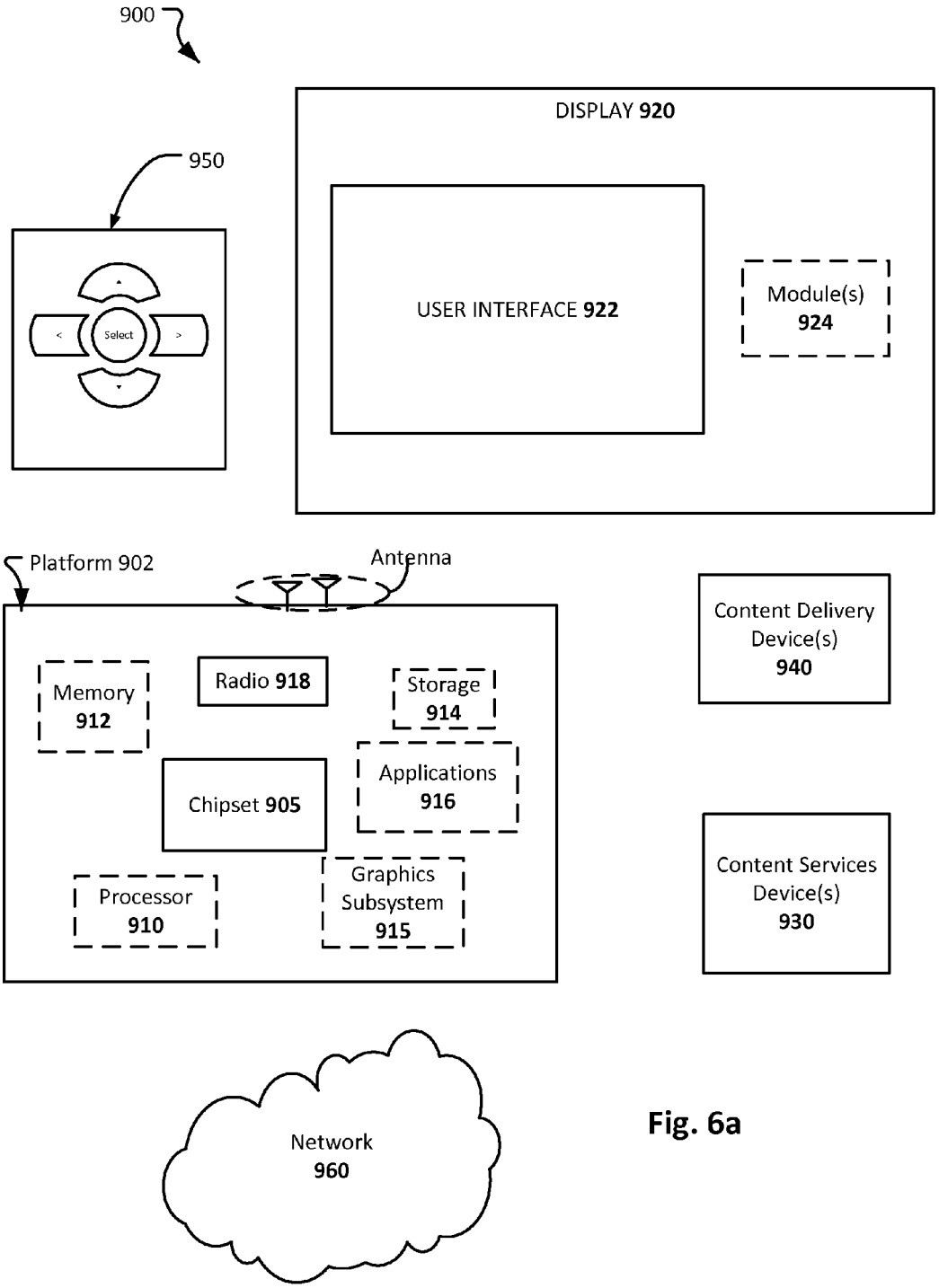
FIGS. 6*a-b* illustrate an example system that may carry out the rendering techniques for textured displays as described herein, in accordance with some embodiments.
Figure 6B:
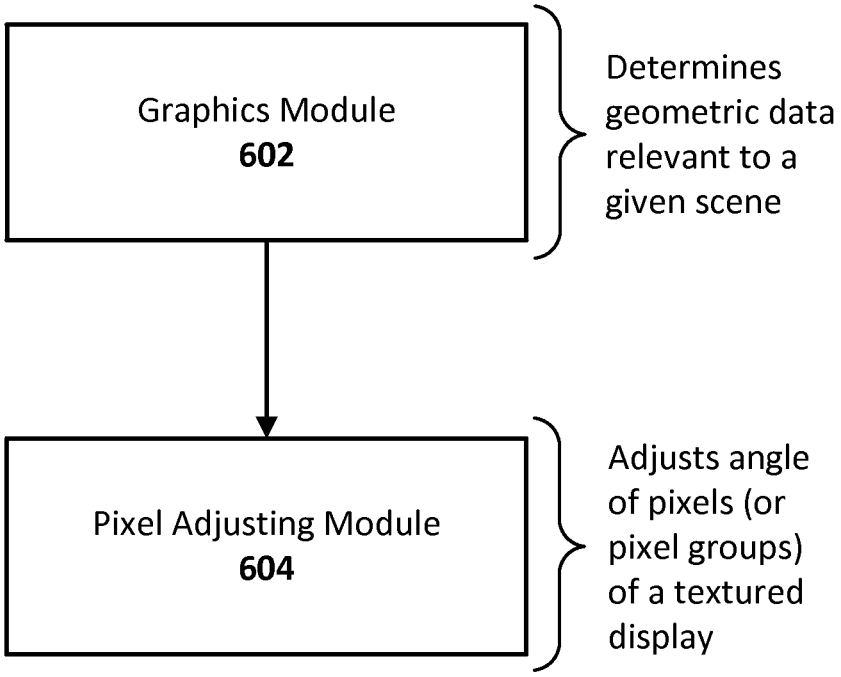

FIGS. 6*a-b* illustrate an example system 900 that may carry out the rendering techniques for textured displays as described herein, in accordance with some embodiments. In some embodiments, system 900 may be a media system although system 900 is not limited to this context. For example, system 900 may be incorporated into a personal computer (PC), laptop computer, ultra-laptop computer, tablet, touch pad, portable computer, handheld computer, palmtop computer, personal digital assistant (PDA), cellular telephone, combination cellular telephone/PDA, television, smart device (e.g., smart phone, smart tablet or smart television), mobile internet device (MID), messaging device, data communication device, set-top box, game console, or other such computing environments capable of performing graphics rendering operations.

In some embodiments, system 900 comprises a platform 902 coupled to a display 920. Platform 902 may receive content from a content device such as content services device(s) 930 or content delivery device(s) 940 or other similar content sources. A navigation controller 950 comprising one or more navigation features may be used to interact with, for example, platform 902 and/or display 920, so as to supplement navigational gesturing by the user. Each of these example components is described in more detail below.

In some embodiments, platform 902 may comprise any combination of a chipset 905, processor 910, memory 912, storage 914, graphics subsystem 915, applications 916 and/or radio 918. Chipset 905 may provide intercommunication among processor 910, memory 912, storage 914, graphics subsystem 915, applications 916 and/or radio 918. For example, chipset 905 may include a storage adapter (not depicted) capable of providing intercommunication with storage 914.

Processor 910 may be implemented, for example, as Complex Instruction Set Computer (CISC) or Reduced Instruction Set Computer (RISC) processors, x86 instruction set compatible processors, multi-core, or any other microprocessor or central processing unit (CPU). In some embodiments, processor 910 may comprise dual-core processor(s), dual-core mobile processor(s), and so forth. In some embodiments, processor 910 may include an accelerated processing unit (APU), which may be designed to accelerate one or more types of computations outside of a CPU or may be designed to replace a very specific task. Memory 912 may be implemented, for instance, as a volatile memory device such as, but not limited to, a Random Access Memory (RAM), Dynamic Random Access Memory (DRAM), or Static RAM (SRAM). Storage 914 may be implemented, for example, as a non-volatile storage device such as, but not limited to, a magnetic disk drive, optical disk drive, tape drive, an internal storage device, an attached storage device, flash memory, battery backed-up SDRAM (synchronous DRAM), and/or a network accessible storage device. In some embodiments, storage 914 may comprise technology to increase the storage performance enhanced protection for valuable digital media when multiple hard drives are included, for example.

Graphics subsystem 915 may perform processing of images such as still or video for display. Graphics subsystem 915 may be a graphics processing unit (GPU) or a visual processing unit (VPU), for example. An analog or digital interface may be used to communicatively couple graphics subsystem 915 and display 920. For example, the interface may be any of a High-Definition Multimedia Interface, DisplayPort, wireless HDMI, and/or wireless HD compliant techniques. Graphics subsystem 915 could be integrated into processor 910 or chipset 905. Graphics subsystem 915 could be a stand-alone card communicatively coupled to chipset 905. The rendering techniques described herein may be implemented in various hardware architectures (e.g., having portions performed by a CPU, GPU, APU, and/or textured display). In still another embodiment, the graphics rendering for textured displays (e.g., causing the change in angle of the display's individual pixels or groups of pixels) may be implemented by a general purpose processor, including a multi-core processor.

Radio 918 may include one or more radios capable of transmitting and receiving signals using various suitable wireless communications techniques. Such techniques may involve communications across one or more wireless networks. Exemplary wireless networks include (but are not limited to) wireless local area networks (WLANs), wireless personal area networks (WPANs), wireless metropolitan area network (WMANs), cellular networks, and satellite networks. In communicating across such networks, radio 918 may operate in accordance with one or more applicable standards in any version.

In some embodiments, display 920 may comprise any television or computer type monitor or display. Display 920 may be a textured display as variously described herein that can be used to provide the rendering effects as previously disclosed. Display 920 may comprise, for example, a liquid crystal display (LCD) screen, electrophoretic display (EPD) or liquid paper display, flat panel display, touch screen display, television-like device, and/or a television. Display 920 may be digital and/or analog. In some embodiments, display 920 may be a holographic, volumetric, or three-dimensional display. Also, display 920 may be a transparent surface that may receive a visual projection. Such projections may convey various forms of information, images, and/or objects. For example, such projections may be a visual overlay for a mobile augmented reality (MAR) application. Under the control of one or more software applications 916, platform 902 may display a user interface 922 on display 920. In some embodiments, display 920 may be capable of adjusting/changing the angle of its individual pixels (or pixel groups) as described herein. For example, display 920 may be an interferometric modulator display (IMOD), which includes micro-electro-mechanical system (MEMS) devices that are capable of tilting. Display 920 may use non-backlit or backlit display technologies, or some combination thereof.

In some embodiments, content services device(s) 930 may be hosted by any national, international and/or independent service and thus accessible to platform 902 via the Internet or other network, for example. Content services device(s) 930 may be coupled to platform 902 and/or to display 920. Platform 902 and/or content services device(s) 930 may be coupled to a network 960 to communicate (e.g., send and/or receive) media information to and from network 960. Content delivery device(s) 940 also may be coupled to platform 902 and/or to display 920. In some embodiments, content services device(s) 930 may comprise a cable television box, personal computer, network, telephone, Internet enabled devices or appliance capable of delivering digital information and/or content, and any other similar device capable of unidirectionally or bidirectionally communicating content between content providers and platform 902 and/display 920, via network 960 or directly. It will be appreciated that the content may be communicated unidirectionally and/or bidirectionally to and from any one of the components in system 900 and a content provider via network 960. Examples of content may include any media information including, for example, video, music, graphics, text, medical and gaming content, and so forth.

Content services device(s) 930 receives content such as cable television programming including media information, digital information, and/or other content. Examples of content providers may include any cable or satellite television or radio or Internet content providers. The provided examples are not meant to limit the present disclosure. In some embodiments, platform 902 may receive control signals from navigation controller 950 having one or more navigation features. The navigation features of controller 950 may be used to interact with user interface 922, for example. In some embodiments, navigation controller 950 may be a pointing device that may be a computer hardware component (specifically human interface device) that allows a user to input spatial (e.g., continuous and multi-dimensional) data into a computer. Many systems such as graphical user interfaces (GUI), and televisions and monitors allow the user to control and provide data to the computer or television using physical gestures.

Movements of the navigation features of controller 950 may be echoed on a display (e.g., display 920) by movements of a pointer, cursor, focus ring, or other visual indicators displayed on the display. For example, under the control of software applications 916, the navigation features located on navigation controller 950 may be mapped to virtual navigation features displayed on user interface 922, for example. In some embodiments, controller 950 may not be a separate component but integrated into platform 902 and/or display 920. Embodiments, however, are not limited to the elements or in the context shown or described herein, as will be appreciated.

In some embodiments, drivers (not shown) may comprise technology to enable users to instantly turn on and off platform 902 like a television with the touch of a button after initial boot-up, when enabled, for example. Program logic may allow platform 902 to stream content to media adaptors or other content services device(s) 930 or content delivery device(s) 940 when the platform is turned "off." In addition, chip set 905 may comprise hardware and/or software support for 5.1 surround sound audio and/or high definition 7.1 surround sound audio, for example. Drivers may include a graphics driver for integrated graphics platforms. In some embodiments, the graphics driver may comprise a peripheral component interconnect (PCI) express graphics card. Application programming interfaces (APIs) may also be included in various embodiments to specify how some software components should interact with each other. For example, APIs such as OpenGL or DirectX may be included to help with the graphics/rendering pipeline.

In various embodiments, any one or more of the components shown in system 900 may be integrated. For example, platform 902 and content services device(s) 930 may be integrated, or platform 902 and content delivery device(s) 940 may be integrated, or platform 902, content services device(s) 930, and content delivery device(s) 940 may be integrated, for example. In various embodiments, platform 902 and display 920 may be an integrated unit. Display 920 and content service device(s) 930 may be integrated, or display 920 and content delivery device(s) 940 may be integrated, for example. These examples are not meant to limit the present disclosure.

As shown in FIG. 6*b*, the system 900 may also include various modules configured to perform the functionality of the rendering techniques for textured displays as variously described herein. In this example embodiment, graphics module 602 may be configured to determine geometric data relevant to a given scene. In some instances, the geometric data may be for a textured display including a plurality of pixels and capable of changing the angle of individual pixels within the display. In some embodiments, the graphics module may be located in one or more components and thus the functionality of the graphics module may be performed by one or more components. For example, the graphics module may be located in one or more of the dashed line components of system 900 shown in FIG. 6*a*, such as within a processor 910 (e.g., a CPU or APU), memory 912, storage 914, a graphics subsystem 915 (e.g., a GPU), and/or an application(s) 916 of platform 902, and/or within a module(s) 924 of display 920 (which may be a textured display).

Once the geometric data has been determined (which may include one or more calculations) by the graphics module 602 shown in FIG. 6*b*, the geometric data may be transferred or otherwise provided to a pixel adjusting module 604. In this example embodiment, pixel adjusting module 604 may be configured to adjust the angle of individual pixels (or groups of pixels) based on the provided geometric data or cause the angle of individual pixels to be adjusted. In some instances, the individual pixels being adjusted may be within a textured display. In some embodiments, the pixel adjusting module may be located in one or more components and thus the functionality of the pixel adjusting module may be performed by one or more components. For example, the pixel adjusting module may be located in one or more of the dashed line components of system 900 shown in FIG. 6*a*, such as within a processor 910 (e.g., a CPU or APU), memory 912, storage 914, a graphics subsystem 915 (e.g., a GPU), and/or an application(s) 916 of platform 902, and/or within a module(s) 924 of display 920 (which may be a textured display).

In various embodiments, system 900 may be implemented as a wireless system, a wired system, or a combination of both. When implemented as a wireless system, system 900 may include components and interfaces suitable for communicating over a wireless shared media, such as one or more antennas, transmitters, receivers, transceivers, amplifiers, filters, control logic, and so forth. An example of wireless shared media may include portions of a wireless spectrum, such as the RF spectrum and so forth. When implemented as a wired system, system 900 may include components and interfaces suitable for communicating over wired communications media, such as input/output (I/O) adapters, physical connectors to connect the I/O adapter with a corresponding wired communications medium, a network interface card (NIC), disc controller, video controller, audio controller, and so forth. Examples of wired communications media may include a wire, cable, metal leads, printed circuit board (PCB), backplane, switch fabric, semiconductor material, twisted-pair wire, co-axial cable, fiber optics, and so forth.

Platform 902 may establish one or more logical or physical channels to communicate information. The information may include media information and control information. Media information may refer to any data representing content meant for a user. Examples of content may include, for example, data from a voice conversation, videoconference, streaming video, email or text messages, voice mail message, alphanumeric symbols, graphics, image, video, text and so forth. Control information may refer to any data representing commands, instructions or control words meant for an automated system. For example, control information may be used to route media information through a system, or instruct a node to process the media information in a predetermined manner (e.g., using hardware assisted for privilege access violation checks as described herein). The embodiments, however, are not limited to the elements or context shown in, or described with reference to, FIGS. 6*a-b*.

Figure 7:
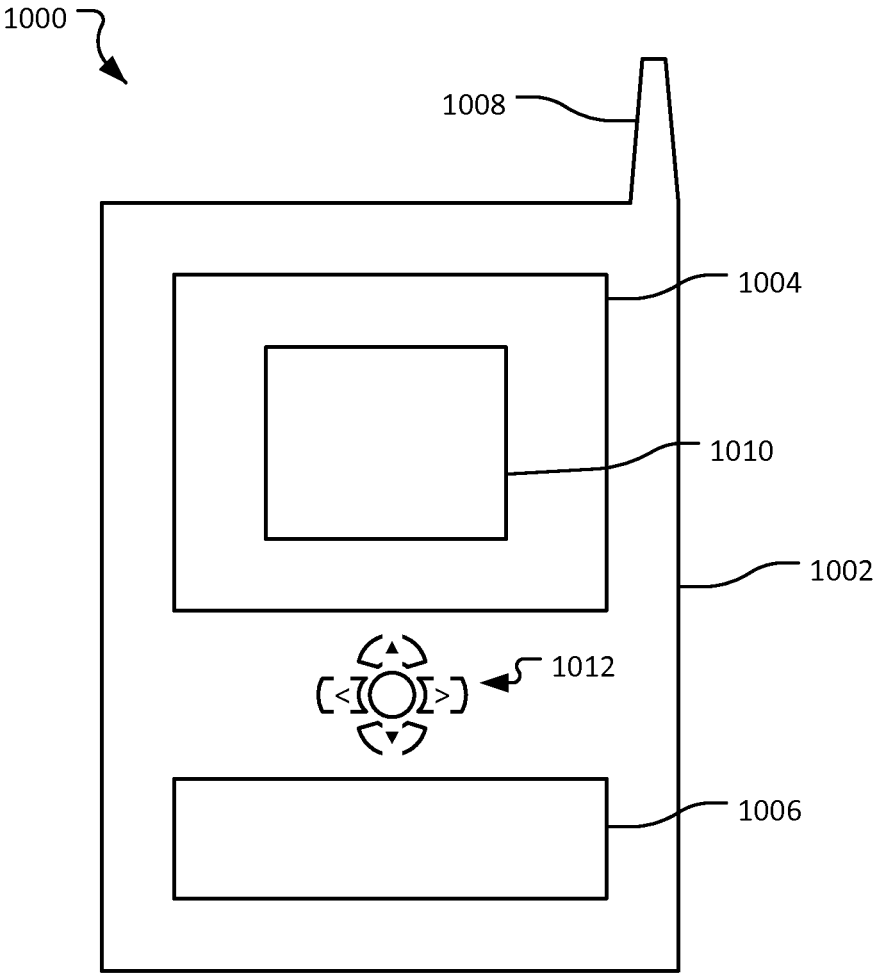
FIG. 7 illustrates embodiments of a small form factor device in which the system of FIGS. 6*a-b* may be embodied.

As described above, system 900 may be embodied in varying physical styles or form factors. FIG. 7 illustrates embodiments of a small form factor device 1000 in which system 900 may be embodied. In some embodiments, for example, device 1000 may be implemented as a mobile computing device having wireless capabilities. A mobile computing device may refer to any device having a processing system and a mobile power source or supply, such as one or more batteries, for example.

As previously described, examples of a mobile computing device may include a personal computer (PC), laptop computer, ultra-laptop computer, tablet, touch pad, portable computer, handheld computer, palmtop computer, personal digital assistant (PDA), cellular telephone, combination cellular telephone/PDA, television, smart device (e.g., smart phone, smart tablet or smart television), mobile internet device (MID), messaging device, data communication device, and so forth.

Examples of a mobile computing device also may include computers that are arranged to be worn by a person, such as a wrist computer, finger computer, ring computer, eyeglass computer, belt-clip computer, arm-band computer, shoe computers, clothing computers, and other wearable computers. In some embodiments, for example, a mobile computing device may be implemented as a smart phone capable of executing computer applications, as well as voice communications and/or data communications. Although some embodiments may be described with a mobile computing device implemented as a smart phone by way of example, it may be appreciated that other embodiments may be implemented using other wireless mobile computing devices as well. The embodiments are not limited in this context.

As shown in FIG. 7, device 1000 may comprise a housing 1002, a display 1004, an input/output (I/O) device 1006, and an antenna 1008. Device 1000 also may comprise navigation features 1012. Display 1004 may comprise any suitable display unit for displaying information appropriate for a mobile computing device. I/O device 1006 may comprise any suitable I/O device for entering information into a mobile computing device. Examples for I/O device 1006 may include an alphanumeric keyboard, a numeric keypad, a touch pad, input keys, buttons, a camera, switches, rocker switches, microphones, speakers, voice recognition device and software, and so forth. Information also may be entered into device 1000 by way of a microphone. Such information may be digitized by a voice recognition device. The embodiments are not limited in this context.

Various embodiments may be implemented using hardware elements, software elements, or a combination of both. Examples of hardware elements may include processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chip sets, and so forth. Examples of software may include software components, programs, applications, computer programs, application programs, system programs, machine programs, operating system software, middleware, firmware, software modules, routines, subroutines, functions, methods, procedures, software interfaces, application program interfaces (API), instruction sets, computing code, computer code, code segments, computer code segments, words, values, symbols, or any combination thereof. Whether hardware elements and/or software elements are used may vary from one embodiment to the next in accordance with any number of factors, such as desired computational rate, power levels, heat tolerances, processing cycle budget, input data rates, output data rates, memory resources, data bus speeds and other design or performance constraints.

Some embodiments may be implemented, for example, using a machine-readable medium or article or computer program product which may store an instruction or a set of instructions that, if executed by a machine, may cause the machine to perform a method and/or operations in accordance with an embodiment of the present disclosure. Such a machine may include, for example, any suitable processing platform, computing platform, computing device, processing device, computing system, processing system, computer, processor, or the like, and may be implemented using any suitable combination of hardware and software. The machine-readable medium or article or computer program product may include, for example, any suitable type of non-transient memory unit, memory device, memory article, memory medium, storage device, storage article, storage medium and/or storage unit, for example, memory, removable or non-removable media, erasable or non-erasable media, writeable or re-writeable media, digital or analog media, hard disk, floppy disk, Compact Disk Read Only Memory (CD-ROM), Compact Disk Recordable (CD-R), Compact Disk Rewriteable (CD-RW), optical disk, magnetic media, magneto-optical media, removable memory cards or disks, various types of Digital Versatile Disk (DVD), a tape, a cassette, or the like. The instructions may include any suitable type of executable code implemented using any suitable high-level, low-level, object-oriented, visual, compiled and/or interpreted programming language. Some embodiments may be implemented in a computer program product that incorporates the functionality of the rendering techniques using textured displays as disclosed herein, and such a computer program product may include one or more machine-readable mediums.

Unless specifically stated otherwise, it may be appreciated that terms such as "processing," "computing," "calculating," "determining," or the like, refer to the action and/or processes of a computer or computing system, or similar electronic computing device, that manipulates and/or transforms data represented as physical quantities (e.g., electronic) within the computing system's registers and/or memories into other data similarly represented as physical quantities within the computing system's memories, registers, or other such information storage, transmission, or displays. The embodiments are not limited in this context.

Further Example Embodiments

The following examples pertain to further embodiments, from which numerous permutations and configurations will be apparent.

Example 1 is a method of rendering graphics comprising: providing three-dimensional (3D) model data for a scene to a textured display including a plurality of pixels and capable of changing the angle of individual pixels within the display, wherein the 3D model data includes at least geometric data for the individual pixels; and adjusting the angle of individual pixels of the textured display based on the provided geometric data.

Example 2 includes the subject matter of any of Examples 1 and 3-9, wherein the geometric data includes surface normal data for the individual pixels.

Example 3 includes the subject matter of any of Examples 1-2 and 4-9, wherein the 3D model data is provided by a central processing unit (CPU), a graphics processing unit (GPU), and/or an accelerated processing unit (APU) of a computing device Example 4 includes the subject matter of any of Examples 1-3 and 5-9, wherein the angle of individual pixels of the textured display is adjusted by a CPU, a GPU, and/or an APU of a computing device, and/or the textured display.

Example 5 includes the subject matter of any of Examples 1-4 and 6-9, wherein the 3D model data is comprised of a 3D mesh of the scene, point clouds, implicit surfaces, and/or voxel representations.

Example 6 includes the subject matter of any of Examples 1-5 and 7-9, wherein the textured display is a non-backlit display causing light to be reflected based on the angle of individual pixels of the textured display.

Example 7 includes the subject matter of any of Examples 1-6 and 8-9, wherein the textured display is an interferometric modulator display (IMOD) including a plurality of tiltable micro-electro-mechanical system (MEMS) devices.

Example 8 includes the subject matter of any of Examples 1-7 and 9, further comprising computing the lighting and shading properties of objects within the scene.

Example 9 includes the subject matter of any of Examples 1-8, wherein the 3D model data further includes color data for the individual pixels.

Example 10 is a method comprising: determining per-pixel surface normal data for a textured display including a plurality of pixels and capable of changing the angle of individual pixels within the display, the surface normal data relevant to a given scene to be presented on the textured display; and transferring the per-pixel surface normal data to the textured display to cause the individual pixels of the textured display to be adjusted.

Example 11 includes the subject matter of any of Examples 10 and 12-19, wherein the per-pixel surface normal data is determined based on at least a three-dimensional (3D) model of the scene to be presented on the textured display.

Example 12 includes the subject matter of any of Examples 10-11 and 13-19, wherein the per-pixel surface normal data is determined based on at least information about glare from external light sources on the textured display.

Example 13 includes the subject matter of Example 12, wherein glare information is collected using one or more light sensors.

Example 14 includes the subject matter of any of Examples 10-13 and 15-19, wherein the per-pixel surface normal data is determined based on at least information about a user's location relative to the textured display.

Example 15 includes the subject matter of Example 14, wherein user location information is collected using one or more cameras.

Example 16 includes the subject matter of any of Examples 10-15 and 17-19, wherein the per-pixel surface normal data is determined based on at least information about angle of tilt of a device including the textured display.

Example 17 includes the subject matter of Example 16, wherein angle of tilt information is collected using one or more accelerometers and/or gyroscopes.

Example 18 includes the subject matter of any of Examples 10-17 and 19, wherein the individual pixels can angle at least 10 degrees along at least one axis of rotation.

Example 19 includes the subject matter of any of Examples 10-18, wherein the method is performed by a CPU, a GPU, and/or an APU of a computing device.

Example 20 is a computer program product encoded with instructions that, when executed by one or more processors, causes a process for graphics rendering to be carried out, the process comprising: determining three-dimensional (3D) model data for a scene to be presented on a textured display including a plurality of pixels and capable of changing the angle of individual pixels within the textured display, wherein the 3D model data includes at least geometric data for the individual pixels; and transferring the geometric data for the individual pixels of the scene to the textured display to cause the textured display to adjust the angle of the individual pixels based on the geometric data.

Example 21 includes the subject matter of any of Examples 20 and 22-28, wherein the geometric data includes surface normal data for the individual pixels.

Example 22 includes the subject matter of any of Examples 20-21 and 23-28, wherein the 3D model data is determined by a CPU, a GPU, and/or an APU of a computing device.

Example 23 includes the subject matter of any of Examples 20-22 and 24-28, wherein a CPU, a GPU, and/or an APU of a computing device, and/or the textured display, cause the textured display to adjust the angle of the individual pixels based on the geometric data.

Example 24 includes the subject matter of any of Examples 20-23 and 25-28, wherein the 3D model data is comprised of a 3D mesh of the scene, point clouds, implicit surfaces, and/or voxel representations.

Example 25 includes the subject matter of any of Examples 20-24 and 26-28, wherein the textured display is a non-backlit display causing light to be reflected based on the angle of individual pixels of the textured display.

Example 26 includes the subject matter of any of Examples 20-25 and 27-28, wherein the textured display is an interferometric modulator display (IMOD) including a plurality of tiltable micro-electro-mechanical system (MEMS) devices.

Example 27 includes the subject matter of any of Examples 20-26 and 28, the process further comprising computing the lighting and shading properties of objects within the scene.

Example 28 includes the subject matter of any of Examples 20-27, wherein the 3D model data further includes color data for the individual pixels.

Example 29 is a computer program product encoded with instructions that, when executed by one or more processors, causes a process for graphics rendering for textured displays to be carried out, the process comprising: determining per-pixel surface normal data for a textured display capable of changing the angle of individual pixels within the textured display; and transferring the per-pixel surface normal data to the textured display to cause the individual pixels of the textured display to be adjusted.

Example 30 includes the subject matter of any of Examples 29 and 31-37, wherein the per-pixel surface normal data is determined based on at least a three-dimensional (3D) model of a scene to be presented on the textured display.

Example 31 includes the subject matter of any of Examples 29-30 and 32-37, wherein the per-pixel surface normal data is determined based on at least information about glare from external light sources on the textured display.

Example 32 includes the subject matter of Example 31, wherein glare information is collected using one or more light sensors.

Example 33 includes the subject matter of any of Examples 29-32 and 34-37, wherein the per-pixel surface normal data is determined based on at least information about a user's location relative to the textured display.

Example 34 includes the subject matter of Example 33, wherein user location information is collected using one or more cameras.

Example 35 includes the subject matter of any of Examples 29-34 and 36-37, wherein the per-pixel surface normal data is determined based on at least information about angle of tilt of a device including the textured display.

Example 36 includes the subject matter of Example 35, wherein angle of tilt information is collected using one or more accelerometers and/or gyroscopes.

Example 37 includes the subject matter of any of Examples 29-36, wherein the individual pixels can angle at least 10 degrees along at least one axis of rotation.

Example 38 is a system comprising: a graphics module configured to determine geometric data for a textured display including a plurality of pixels and capable of changing the angle of individual pixels within the textured display, the geometric data relevant to a given scene to be presented on the textured display; and a pixel adjusting module configured to cause the angle of individual pixels of the textured display to be adjusted based on the provided geometric data.

Example 39 includes the subject matter of any of Examples 38 and 40, wherein the graphics module is located in a CPU, a GPU, and/or an APU of one or more computing devices, and/or in the textured display.

Example 40 includes the subject matter of any of Examples 39-40, wherein the pixel adjusting module is located in a CPU, a GPU, and/or an APU of one or more computing devices, and/or in the textured display.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future filed applications claiming priority to this application may claim the disclosed subject matter in a different manner, and may generally include any set of one or more limitations as variously or otherwise demonstrated disclosed herein.

What is claimed is:

1. A method comprising:

determining per-pixel surface normal data for a textured display including a plurality of pixels and capable of changing the angle of individual pixels within the textured display, the surface normal data relevant to a given scene to be presented on the textured display; and transferring the per-pixel surface normal data to the textured display to cause the angle of the individual pixels of the textured display to be adjusted based on the per-pixel surface normal data in effort to improve upon the visual realism of the given scene when presented on the textured display.

2. The method of claim 1 wherein the per-pixel surface normal data is determined based on at least a three-dimensional (3D) model of the scene to be presented on the textured display.

3. The method of claim 1 wherein the per-pixel surface normal data is determined based on at least information about glare from external light sources on the textured display.

4. The method of claim 3 wherein glare information is collected using one or more light sensors.

5. The method of claim 1 wherein the per-pixel surface normal data is determined based on at least information about a user's location relative to the textured display.

6. The method of claim 5 wherein user location information is collected using one or more cameras.

7. The method of claim 1 wherein the per-pixel surface normal data is determined based on information about lighting in the environment and information about a user's location relative to the textured display.

8. The method of claim 1 wherein, in response to an adjustment of the angle of one or more individual pixels of the textured display, there is no change to tactile properties of the textured display.

9. The method of claim 1 wherein the textured display includes micro-electro-mechanical-system (MEMS) devices capable of tilting to change the angle of individual pixels within the textured display.

10. A non-transitory computer program product encoded with instructions that, when executed by one or more processors, causes a process for graphics rendering to be carried out, the process comprising:

determining three-dimensional (3D) model data for a scene to be presented on a textured display including a plurality of pixels and capable of changing the angle of individual pixels within the textured display, wherein the 3D model data includes at least geometric data for the individual pixels; and transferring the geometric data for the individual pixels of the scene to the textured display to cause the angle of the individual pixels of the textured display to be adjusted based on the geometric data in effort to improve upon the visual realism of the scene when presented on the textured display.

11. The computer program product of claim 10 wherein the geometric data includes surface normal data for the individual pixels.

12. The computer program product of claim 10 wherein the 3D model data is determined based on information about lighting in the environment and information about a user's location relative to the textured display.

13. The computer program product of claim 10 wherein, in response to an adjustment of the angle of one or more individual pixels of the textured display, there is no change to tactile properties of the textured display.

14. The computer program product of claim 10 wherein the 3D model data is comprised of a 3D mesh of the scene, point clouds, implicit surfaces, and/or voxel representations.

15. The computer program product of claim 10 wherein the textured display is a non-backlit display causing light to be reflected based on the angle of individual pixels of the textured display.

16. The computer program product of claim 10 wherein the textured display is an interferometric modulator display (IMOD) including a plurality of tiltable micro-electro-mechanical system (MEMS) devices capable of tilting to change the angle of individual pixels within the textured display, and wherein a change in the tilt of one or more of the MEMS devices is intangible.

17. The computer program product of claim 10, the process further comprising computing the lighting and shading properties of objects within the scene.

18. A non-transitory computer program product encoded with instructions that, when executed by one or more processors, causes a process for graphics rendering for textured displays to be carried out, the process comprising:

determining per-pixel surface normal data for a textured display capable of changing the angle of individual pixels within the textured display, the surface normal data relevant to a given scene to be presented on the textured display; and transferring the per-pixel surface normal data to the textured display to adjust the angle of the individual pixels of the textured display based on the per-pixel surface normal data in effort to improve upon the visual realism of the given scene when presented on the textured display.

19. The computer program product of claim 18 wherein the per-pixel surface normal data is determined based on at least a three-dimensional (3D) model of a scene to be presented on the textured display.

20. The computer program product of claim 18 wherein the per-pixel surface normal data is determined based on at least information about glare from external light sources on the textured display.

21. The computer program product of claim 18 wherein the per-pixel surface normal data is determined based on at least information about a user's location relative to the textured display.

22. The computer program product of claim 18 wherein the per-pixel surface normal data is determined based on at least information about angle of tilt of a device including the textured display.

23. A system comprising:

one or more processors;

a graphics module at least one of executable and controllable by the one or more processors and configured to determine geometric data for a textured display including a plurality of pixels and capable of changing the angle of individual pixels within the textured display, the geometric data relevant to a given scene to be presented on the textured display; and a pixel adjusting module at least one of executable and controllable by the one or more processors and configured to adjust the angle of individual pixels of the textured display based on the provided geometric data in effort to improve upon the visual realism of the given scene when presented on the textured display.

24. The system of claim 23 wherein the graphics module is located in a CPU, a GPU, and/or an APU of one or more computing devices, and/or in the textured display.

25. The system of claim 23 wherein the pixel adjusting module is located in a CPU, a GPU, and/or an APU of one or more computing devices, and/or in the textured display.

* * * * *